US007377338B2

(12) United States Patent
Bassinger

(10) Patent No.: US 7,377,338 B2
(45) Date of Patent: May 27, 2008

(54) DOWNHOLE PERCUSSION TOOL

(76) Inventor: Grey Bassinger, 905 Shirley Court, Midland, TX (US) 79705-6528

( * ) Notice: Subject to any disclaimer, the term of this patent is extended or adjusted under 35 U.S.C. 154(b) by 263 days.

(21) Appl. No.: 11/266,968

(22) Filed: Nov. 4, 2005

(65) Prior Publication Data

US 2007/0102196 A1 May 10, 2007

(51) Int. Cl.
*E21B 4/14* (2006.01)
*E21B 10/36* (2006.01)

(52) U.S. Cl. ..... 175/296; 175/297; 175/414; 175/418

(58) Field of Classification Search ..... 175/293, 175/296, 297, 405, 407, 414, 417, 418, 415, 175/420.1, 420.2
See application file for complete search history.

(56) References Cited

U.S. PATENT DOCUMENTS

| | | | | | |
|---|---|---|---|---|---|
| 2,947,519 | A * | 8/1960 | Feucht | ..... | 173/73 |
| 3,361,219 | A * | 1/1968 | Sears | ..... | 173/64 |
| 3,527,239 | A * | 9/1970 | Boom | ..... | 173/64 |
| 3,964,551 | A | 6/1976 | Bassinger | | |
| 3,970,152 | A | 7/1976 | Harris et al. | | |
| 4,003,442 | A | 1/1977 | Bassinger | | |
| 4,030,554 | A * | 6/1977 | Kammerer et al. | ..... | 173/17 |
| 4,044,844 | A | 8/1977 | Harris et al. | | |
| 4,054,180 | A | 10/1977 | Bassinger | | |
| 4,067,405 | A | 1/1978 | Bassinger | | |
| 4,100,976 | A * | 7/1978 | Stone | ..... | 173/133 |
| 4,171,025 | A | 10/1979 | Bassinger | | |
| 4,303,138 | A | 12/1981 | Bassinger | | |
| 4,333,537 | A * | 6/1982 | Harris et al. | ..... | 173/17 |
| 4,790,390 | A * | 12/1988 | Sweeny | ..... | 173/17 |
| 4,844,181 | A | 7/1989 | Bassinger | | |
| 5,277,260 | A * | 1/1994 | Ranck | ..... | 173/17 |
| 5,947,215 | A * | 9/1999 | Lundell | ..... | 175/417 |
| 6,173,798 | B1 | 1/2001 | Bryant et al. | | |
| 6,464,023 | B2 * | 10/2002 | Patterson | ..... | 175/93 |
| RE38,151 | E | 6/2003 | Penkunas et al. | | |

OTHER PUBLICATIONS

Kennametal, Inc., Surface Mining, Catalog, copyright 2004, covers and pp. 31-39, Latrobe, PA.
Mills Machine Company, Inc., Rotary Claw Bits, Catalog, copyright 2004, covers and pp. 7-1 to 7-5, Shawnee, OK.

* cited by examiner

*Primary Examiner*—Kenneth Thompson
(74) *Attorney, Agent, or Firm*—Gadere Wynne Sewell, LLP; Scott C. Sample

(57) ABSTRACT

A pressure fluid actuated downhole percussion tool includes a reciprocating piston hammer with differential transverse pressure surfaces cooperable with a cylinder housing, a guide sleeve and a bit carried exhaust tube to form opposed pressure fluid chambers to which pressure fluid may be conducted to deliver repeated impact blows to a bit having circumferentially spaced bosses and replaceable cutting inserts. The bit is drivenly connected to the tool by plural drive pins supported in circumferentially spaced grooves in the bit shank and in a removable sub supported by the tool housing. Improved earth penetration performance is realized utilizing a claw bit with a pressure fluid actuated percussion tool providing rotation as well as selective deliverance of impact blows through the bit.

29 Claims, 4 Drawing Sheets

DOWNHOLE PERCUSSION TOOL

BACKGROUND OF THE INVENTION

There have been many developments in the art of equipment for drilling holes in earth formations, including relatively soft as well as medium and hard formations. For example, in relatively soft formations so-called rotary drilling equipment is typically used in drilling wells and blastholes. However, as the hardness of the formation increases, rotary drilling becomes inefficient and expensive due to frequent requirements to repair the drilling equipment including replacement of the drillbit. In relatively hard formations downhole reciprocating piston pressure fluid operated percussion type tools are more effective in hole formation. Downhole percussion tools typically utilize a so-called button type bit, that is a bit with a relatively flat or angled transverse face with plural hard metal inserts disposed thereon for impacting and breaking the formation as the bit transfers the energy of reciprocating piston hammer blows to the formation and while indexing or rotation of the bit is undertaken. Chip evacuation is carried out by spent working fluid, normally compressed air.

Formations of intermediate hardness are sometimes the most difficult to penetrate efficiently since they do not respond well to drilling with strictly rotary type equipment and rotary bits or with strictly percussion type equipment and bits. A so-called claw bit has been developed for drilling, primarily in relatively soft formations, and utilizing conventional rotary drilling equipment. Heretofore this type of bit has not been adapted for use with percussion type drilling equipment since it has been considered that bit life would be substantially reduced. However, in accordance with the present invention an improved downhole reciprocating piston hammer type drill or percussion tool has been developed which is particularly adapted for use with an improved claw type bit, including a bit with replaceable hard metal inserts that may be easily replaced to extend bit life and to minimize the need to disassemble the tool to replace or repair the bit.

SUMMARY OF THE INVENTION

The present invention provides an improved downhole percussion tool, particularly adapted for drilling wells and blastholes in earth formations and the like.

In accordance with one aspect of the present invention, a downhole reciprocating piston fluid actuated percussion tool is provided which is adapted for operation with an integral claw bit. The percussion tool includes a unique drive sub or coupling between the bit and the tool housing to facilitate rotation of the bit and to also allow repeated impact blows to be delivered to and transmitted through the bit for forming and removing cuttings from the drill hole. The combination of a unique reciprocating piston fluid actuated piston hammer percussion tool with an improved claw bit in accordance with the invention has provided improved rates of formation penetration in earth formations of relatively low and intermediate or medium hardness. The use of a claw type bit in relatively hard or intermediate hardness earth formations in combination with a tool which may be rotated as well as deliver impact blows to the bit has been seen to be particularly advantageous.

The present invention further provides an improved downhole percussion tool including features such as an uncomplicated, reversible cylinder or housing member, an easily replaceable piston hammer guide or wear sleeve for engaging and guiding a reciprocating piston hammer, improved piston packing or piston ring construction, a unique pressure fluid delivery system and a unique drive coupling between the drill housing and the shank portion of the drillbit or a bit adapter.

In accordance with another aspect of the invention, an improved downhole percussion tool is provided which is relatively uncomplicated, easy to fabricate, and is efficient in the use of pressure fluid, such as compressed air, for effecting repeated impact blows to a bit shank portion. Easily replaceable guide or wear sleeve and exhaust control tube members provide for modifying tool performance in accordance with the pressure of the working fluid. The invention also contemplates the provision of a downhole percussion tool with an improved pressure fluid control or check valve interposed a source of pressure fluid and the tool working chambers and operably connected to and supported by a sub or coupling member for the tool. The percussion tool of the invention is easily assembled and disassembled for repair or replacement of all working parts, if necessary.

Still further, the present invention contemplates the provision of a downhole fluid actuated percussion tool which may utilize pressure fluid, such as compressed air, with or without entrained lubricants, may be operated at relatively low rotation speeds while delivering repeated impact blows through an improved claw bit or a conventional claw bit connected to a unique adapter which may be used in conjunction with the tool in place of an integrated claw bit.

The present invention further provides an improved earth penetrating bit adapted for drilling in medium hardness formations, in particular, wherein the bit is operable to deliver impact blows and rotary motion through so-called claw-type cutting inserts. The integrated configuration of the bit of the invention provides improved earth penetration rates as compared with conventional rotary bits.

Those skilled in the art will further appreciate the above-mentioned advantages and superior features of the invention together with other important aspects thereof upon reading the detailed description which follows in conjunction with the drawings.

BRIEF DESCRIPTION OF THE DRAWING

FIG. 1A is intended to be joined to FIG. 1B along the common line a-a;

DETAILED DESCRIPTION OF THE PREFERRED EMBODIMENTS

Figure 1A:
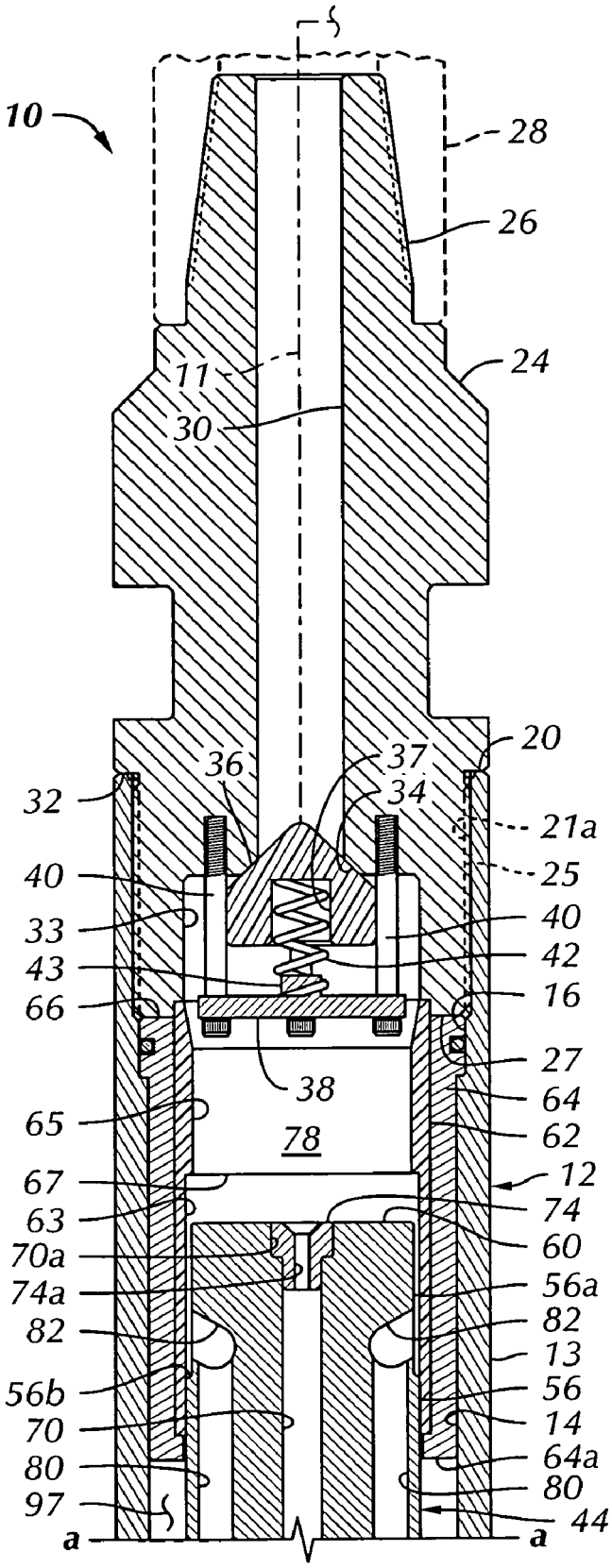
FIGS. 1A and 1B comprise a longitudinal central section view of a downhole percussion tool in accordance with the invention whereby

In the description which follows like parts are marked throughout the specification and drawings with the same reference numerals, respectively. The drawing figures are not necessarily to scale and certain features may be shown in somewhat general or schematic form in the interest of clarity and conciseness.

Figure 1B:
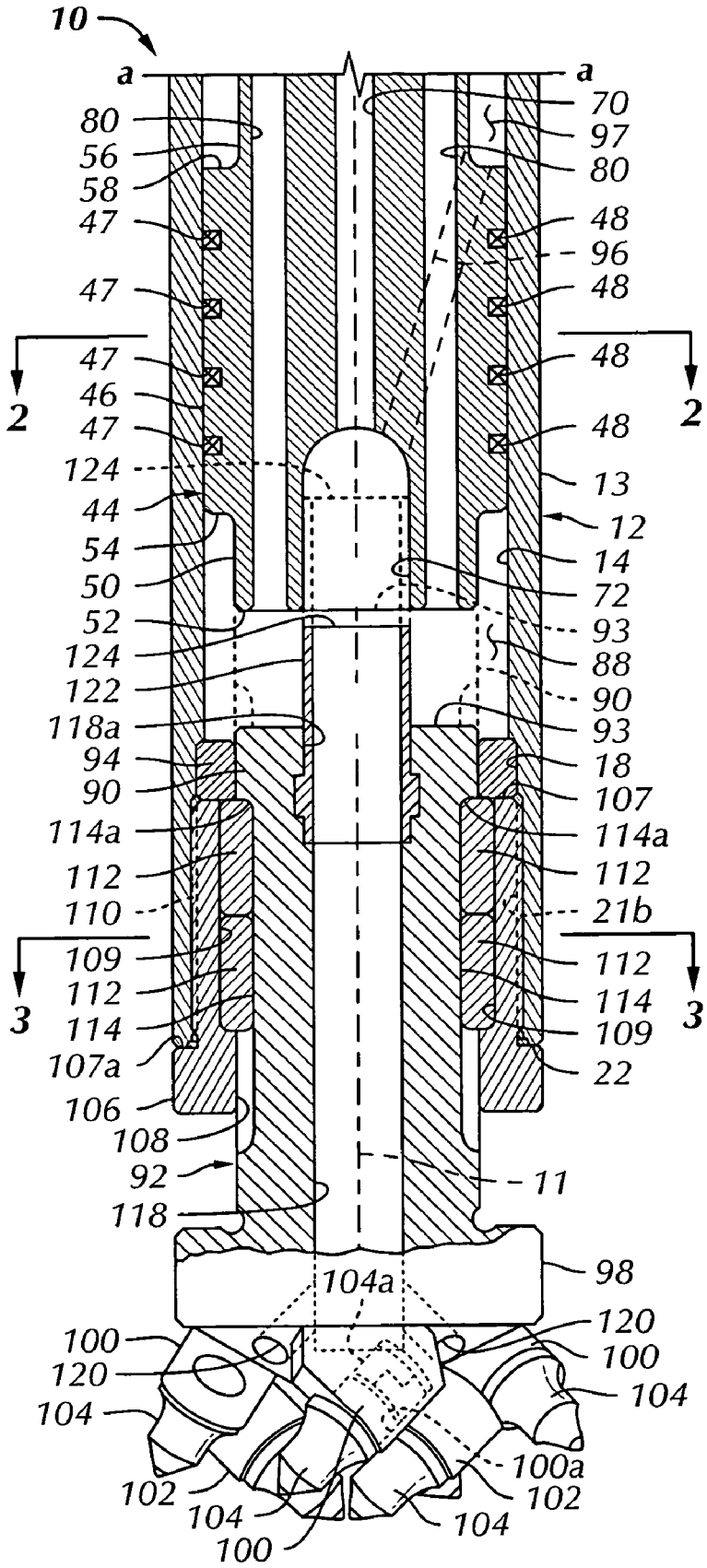

Referring to FIGS. 1A and 1B, there is illustrated an improved downhole, pressure fluid actuated, reciprocating piston hammer, percussion tool in accordance with the invention and generally designated by the numeral 10. The percussion tool 10 includes an elongated tubular cylinder housing member 12 having a cylindrical outer wall 13 and an inner cylindrical borewall 14, FIGS. 1A and 1B. Cylinder housing 12 includes an elongated cylindrical bore formed by the borewall 14 and slightly enlarged diameter bore portions 16, FIGS. 1A, and 18, FIG. 1B. Bore portions 16 and 18 are disposed between the bore wall 14 and opposite end faces 20, FIGS. 1A, and 22, FIG. 1B. A helical threaded portion 21*a* is interposed the bore portion 16 and the end face 20 and a helical threaded portion 21*b* is interposed the end face 22 and the bore portion 18. The cylinder housing 12 is essentially symmetrical about a transverse mid point and may be adapted to be reversed with respect to components that are connected to the housing, if desired. In all events, when the percussion tool or drill 10 is being assembled, it makes no difference which components are connected to which end of the cylinder housing 12, thus simplified manufacturing, assembly and disassembly is provided.

Referring to FIG. 1A, the percussion tool 10 is characterized by a rear adapter or sub 24 of generally cylindrical configuration and including a conventional tapered threaded end portion 26 for connecting the tool to a conventional hollow rotatable drill stem 28. An elongated central passage 30 extends through adapter or sub 24 for conducting pressure fluid to the interior of the tool 10 for purposes to be described further herein. Sub 24 is also provided with suitable helical threads 25 on a lower end thereof, viewing FIG. 1A, cooperable with the threaded portions 21 or 22 of the cylinder housing 12 for connecting the sub to the housing, as illustrated in FIG. 1A. A transverse shoulder portion 32 on sub 24 is engageable with the end face 20 of cylinder housing 12. Interior passage 30 opens into an enlarged diameter bore part 33 of sub 24 and includes a frustoconical surface 34 interposed the passage 30 and the bore portion 33 and forming a seat for a check valve closure member 36. Closure member 36 is preferably formed of a suitable elastomeric or thermoplastic material, and is supported in its working positions by a cylindrical backplate 38 secured to the sub 24 by four equally spaced socket head screw fasteners 40, three shown in FIG. 1A. Closure member 36 is biased to the valve closed position by a coil spring 42 disposed on a pilot boss 43 formed on backplate 38 and also disposed in a bore 37 formed in closure member 36.

Referring further to FIGS. 1A and 1B, percussion tool 10 is also characterized by an elongated generally cylindrical reciprocating piston hammer, generally designated by the numeral 44. Piston hammer 44 includes an enlarged diameter portion 46, FIG. 1B, disposed in housing 12 in free sliding but close fitting relationship to borewall 14. Spaced apart circumferential piston ring receiving grooves 47 are formed in enlarged diameter portion 46 of piston hammer 44, as shown in FIG. 1B, and are adapted to receive suitable piston rings or packings 48, respectively. Piston rings or packings 48 may be graphite filled braided Teflon brand fluorocarbon packing having a substantially square or rectangular cross-sectional shape, as illustrated.

Referring further to FIGS. 1A and 1B, piston hammer 44 includes a first reduced diameter portion 50, FIG. 1B, delimited by a transverse impact blow delivery surface or end face 52 and also forming a transverse shoulder 54 between reduced diameter portion 50 and enlarged diameter portion 46. As shown in FIGS. 1A and 1B, piston hammer 44 includes a second opposed reduced diameter portion 56 extending rearward or upward from enlarged diameter portion 46 and forming a transverse annular shoulder 58 therebetween. Reduced diameter portion 56 extends rearwardly or upwardly, viewing FIG. 1B, to a third reduced diameter portion 56*a* slightly less in diameter than reduced diameter portion 56 and extending to an upper or rearward transverse end face 60. A transverse shoulder or cutoff edge 56*b* is formed on piston hammer 44 between reduced diameter portions 56 and 56*a*.

Reduced diameter portion 56 of piston hammer 44 is slidably received in close fitting relationship with an elongated guide or wear sleeve 62 serving as a bearing member, FIG. 1A. Sleeve 62 is disposed in a tubular adapter part 64 easily removably disposed in cylinder bore portions 14 and 16 and retained fixed therein by sub 24 at cooperating engaged end faces 66 and 27, FIG. 1A. Guide or wear sleeve 62 includes a stepped bore characterized by an enlarged diameter bore portion 63 and a slightly reduced diameter bore portion 65. Bore portion 63 and 65 are dimensioned to slidably receive the piston hammer 44 whereby reduced diameter portion 56 of the piston hammer is snugly but slidably received in bore portion 63 and reduced diameter portion 56*a* is slidably but snugly disposable in bore portion 65. A transverse shoulder or cutoff edge 67 is formed between bore portions 63 and 65.

Figure 2:
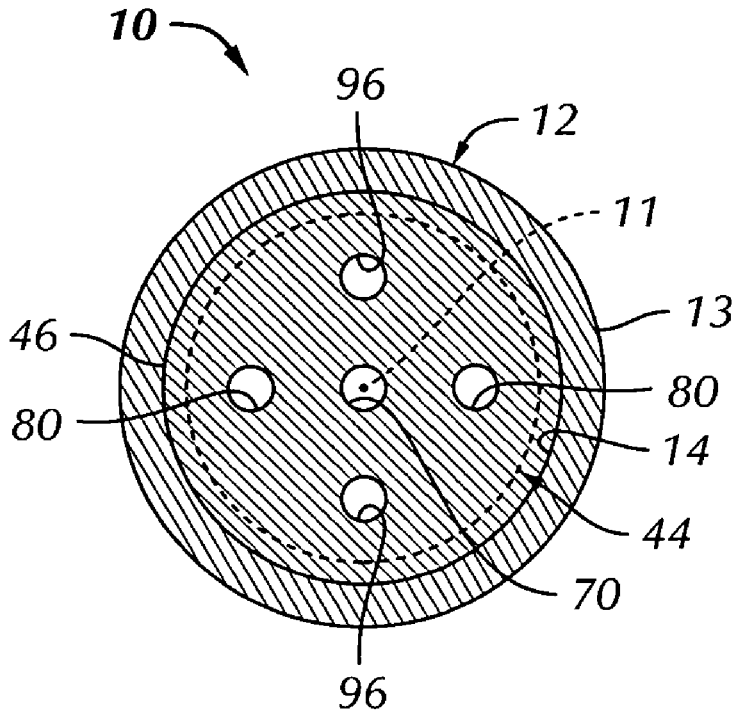
FIG. 2 is a section view taken generally from the line 2-2 of FIG. 1B.

Referring still further to FIGS. 1A and 1B, and FIG. 2, piston hammer 44 is provided with a central elongated fluid conducting passage 70 opening to an enlarged diameter passage 72, FIG. 1B, whereby passage 72 opens to end face 52. Passage 70 also opens to end face 60 and a removable orifice plug 74 is suitably disposed in an enlarged diameter portion 70*a* of passage 70 and is provided with an orifice 74*a* for limiting the flow of hole cleaning pressure fluid, such as compressed air, through passage 70 from a pressure fluid chamber 78 formed between check valve 36 and piston hammer end face 60, as shown in FIG. 1A. Piston hammer 44 still further includes at least two, opposed, longitudinally extending fluid conducting passages 80 which open to end face 52 and extend toward respective fluid inlet ports 82, FIG. 1A, which open to the exterior of reduced diameter piston hammer portion 56*a*, as illustrated. Accordingly, pressure fluid, such as compressed air, delivered into chamber 78 from passage 30 past check valve 36, may flow through the annular space between bearing bore 63 and reduced diameter portion 56*a* of piston hammer 44, as long as transverse end face 60 is disposed in the bore portion 63 and below the shoulder 67, viewing FIG. 1A.

Thus, pressure fluid may flow through passages 80 into a chamber 88 formed between piston hammer 44 and a generally cylindrical shank 90 of an integrated claw impact blow receiving bit in accordance with the invention and generally designated by the numeral 92, FIG. 1B. Shank 90 is also adapted for limited axial movement with respect to a removable cylindrical guide ring 94 removably retained in the enlarged diameter bore portion 18 of housing 12, as shown in FIG. 1B. Guide ring 94 may be formed of a suitable bearing material, such as aluminum bronze. Referring again briefly to FIGS. 1A, 1B and FIG. 2, piston hammer 44 is also provided with elongated exhaust passages 96 which open into passage 72 and to an annular chamber 97 formed between a transverse end face 64*a* of adapter 64 and transverse shoulder 58 of piston hammer 44. One of exhaust passages 96 is shown rotated into the plane of FIG. 1B for purposes of illustration, but passages 96 are offset from passages 80 about ninety degrees with respect to central axis 11 of tool 12.

Figure 3:
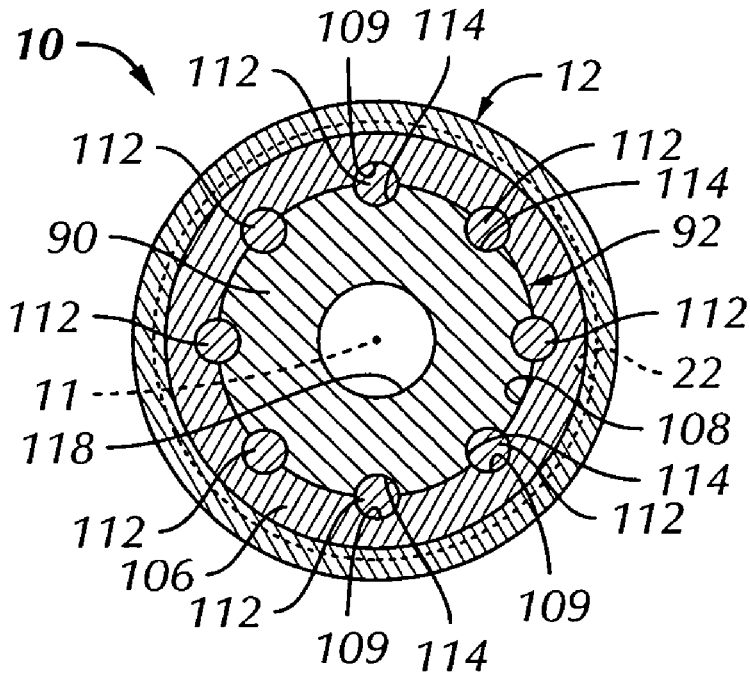
FIG. 3 is a section view taken generally from the line 3-3 of FIG. 1B.

Referring now to FIGS. 1B and 3, integrated claw bit 92 includes a bit head part 98 integrally formed with the shank 90 and supporting circumferentially spaced bosses 100 and 102, each adapted to support a rotatable hard metal formation cutting or breaking insert 104 which may be of a type disclosed in U.S. Patent RE 38,151 E to Penkunas et al., for example. Cutting inserts 104 are disposed in bores 100*a*, for example, formed in bosses 100 and 102, respectively, and retained in said bores by suitable retainer sleeves 104*a*. Bosses 100 are circumferentially spaced about axis 11 and cutting inserts 104 each project downwardly viewing FIG. 1B, at an acute angle, respectively, with respect to axis 11. Such angles are measured between the longitudinal centerlines of inserts 104 and axis 11, respectively, and preferably are in a range of about fifteen degrees to forty-five degrees. Cutting inserts 104, together with the bosses 100 and the shank and body portions of bit 92 may be referred to as a claw bit, generally. However, the blow receiving shank 90 is provided with a transverse endface or anvil surface 93 adapted to receive impact blows from piston hammer 44 and transfer blow energy to and through inserts 104 to a formation being penetrated. Integral shank 90 is disposed for limited axial movement in a removable cylindrical drive sub 106 having a central bore 108 formed therein and provided with helical threads 110 for threaded engagement with the threads 21*b* on tool cylinder or housing 12. Sub 106 includes a transverse end face 107 spaced from a shoulder 107*a* and operable for retaining the guide ring 94 in the position shown in FIG. 1B when shoulder 107*a* engages end face 22 of housing 12.

Drive sub 106 and bit shank 90 are also drivingly engaged whereby, when percussion tool 10 is rotated about its longitudinal axis 11, FIGS. 1A and 1B, bit 92 is rotatably driven as well as being in receipt of repeated impact blows from piston hammer 44. As shown in FIGS. 1B and 3, drive sub 106 is provided with axially extending, circumferentially spaced, elongated, arcuate, parallel grooves 109, eight shown, opening to cylindrical borewall 108 for receiving cylindrical drive pins 112. Drive pins 112 are also received in cooperating longitudinal, arcuate, parallel grooves 114 formed in shank 90 of bit 92, as illustrated in FIGS. 1B and 3. Drive pins 112 are each of a predetermined length such that they may be placed in the cooperating grooves 109 and 114 when the bit 92 and sub 106 are removed from housing 12 and the shank 90 is moved axially upward with respect of the drive sub 106 until a sufficient clearance is provided between the upper ends 114*a* of grooves 114 and the end face 107 of the sub to allow insertion of the pins 112. Then, when all of the pins 112 are inserted in the respective cooperating grooves 109 and 114 and the assembly of drive sub 106 and bit 92 is assembled to the cylinder housing 12, the dimensional relationships are such that the pins 112 are retained in the grooves 109 and 114 and the bit 92 is allowed to move a limited distance axially in the housing 12, as indicated by the dashed lines in FIG. 1B.

Referring further to FIG. 1B, the bit 92 is provided with an axial fluid conducting passage 118 which opens into respective angled exhaust passages 120 for conducting drill cuttings evacuation fluid into a borehole being formed by the tool 10. An elongated bit carried fluid exhaust tube 122 is secured on the shank 90 and extends axially to a distal end 124, FIG. 1B. Tube 122 may be formed of a suitable plastic or composite material, such as Delrin brand acetal thermoplastic, and is readily replaceable within a suitable stepped counterbore 118*a* formed in shank 90. When the tool 10 is not engaged with a rock formation, the bit 92 will move to the position shown by the solid lines in FIG. 1B. When the bit 92 is engaged with a formation at the bottom of a borehole and downward pressure is placed on the tool 10, the bit will move relative to housing 12 to the position shown by the dashed lines in FIG. 1B and the tube 122 will be disposed in passage 72 in somewhat snug fitting but sliding relationship, allowing communication of pressure fluid from the passage 70 through passage 118, but closing off communication between the passage 118 and the chamber 88.

In operation of the percussion tool 10, when pressure fluid, such as dry compressed air, is supplied from a source, not shown, through passage 30, past check valve 36 into chamber 78, fluid is allowed to flow through passage 70 for borehole cleaning purposes regardless of the position of piston hammer 44. If bit 92 is in the position shown by the solid lines of FIG. 1B, the piston hammer 44 will move downwardly toward engagement with the anvil surface 93 and this movement will be sufficient to allow shoulder 56*b* between the reduced diameter portions 56 an 56*a* to move downwardly past the transverse surface 64*a* thereby allowing communication of high pressure fluid from chamber 78 into chamber 97. The effective total cross-section area of the transverse surfaces 58 and 60 and the shoulder 56*b* are equal to the total cross-sectional area of the surfaces 52 and 54 and if piston hammer 44 moves downward to cutoff communication between chamber 88 and passage 118, forces acting on the piston hammer will, at least, be substantially in balance and the piston hammer will not undergo reciprocating impact blow delivery strokes.

When the tool 10 is placed in a position such that the bit 92 is urged upwardly to the position indicated by the dashed lines in FIG. 1B, the piston hammer 44 will be urged to the position shown by the solid lines in FIGS. 1A and 1B. In this position, the flow of high pressure fluid from chamber 78 to chamber 97 is terminated since the reduced diameter portion 56 is in close fitting relationship with the bore wall 63 of sleeve 62. In this condition, pressure fluid is still communicated through passages 80 to chamber 88 while pressure fluid is vented from chamber 97 through passages 96 and exhaust tube 122 to the exterior of the tool by way of the passages 118 and 120. Thus, a resultant force is exerted on the piston hammer 44 driving it upwardly, viewing FIGS. 1A and 1B, until the reduced diameter portion 56*a* moves past cutoff edge 67 into close fitting but sliding relationship with the borewall 65 of guide sleeve 62 thereby cutting off communication of high pressure fluid to ports 82, passages 80 and chamber 88. A resultant pressure fluid force acting on piston hammer 44 will continue to drive the piston hammer upwardly, viewing FIGS. 1A and 1B, until surface 52 moves past the upper transverse edge 124 of tube 122 thereby allowing venting of pressure fluid from chamber 88 through passages 118 and 120. In this condition, a net resultant pressure fluid force acting on transverse surface 60 is sufficient to drive the piston hammer 44 downwardly to deliver an impact blow to anvil surface 93 and the cycle just described will then repeat itself rapidly and in accordance with the design parameters of the tool 10.

Accordingly, the length of tube 122 and the location of cutoff edge 67 are operable to control reciprocation of piston hammer 44. Sleeve 62 and tube 122 may be replaced with corresponding parts of different dimensions regarding the location of cutoff edge 67 and the effective length of tube 122 to control tool performance for different available fluid supply pressures, for example. A tool 10 adapted for drilling a 6.0 inch to 6.5 inch diameter hole, having a piston hammer 44 with a weight of about forty pounds and a bit 92 of approximately the same weight, or a weight up to about sixty pounds, may operate in a range of 1500 to 1600 blows per minute at 100 psig pressure air as the source pressure fluid. For higher blow rates in the range of 4,000 to 4,500 bpm (blows per minute), pressure air supplied at about 300 psig may provide such performance.

A particular advantage of the unitized or integrated bit 92 with respect to the tool 10 is that the bit overall weight may be reduced. Accordingly, for efficient operation the weight of the piston hammer 44 may also be reduced and the piston hammer impact rate in blows per minute may be increased for a given air pressure. In other words, the efficiency and overall performance of the tool 10 is improved as a result of the provision of the integrated bit 92, a feature which has been heretofore unappreciated in the prior art with respect to so-called claw type bits.

A pressure fluid operated percussion tool 10 operating on so-called dry air pressure air in the pressure ranges mentioned above, that is, air which does not require a tool lubricant to be injected therein, and having the design parameters mentioned above has been tested at rotational speeds of from sixty rpm to one hundred rpm (revolutions per minute) and has exhibited performance in the way of penetration rates in hard silica sandstone, for example, at least double the penetration rate of a conventional rotary drilling tool utilizing a conventional claw bit. Thanks to the integrated claw bit 92 and the unique structure providing a rotational driving relationship between the tool housing 12 and the bit, preferred earth formation penetration rates have been realized with a tool which is relatively economical to manufacture and may be driven at relatively low rotational torque and relatively low impact blow rates while exhibiting superior penetration performance.

Figure 4:
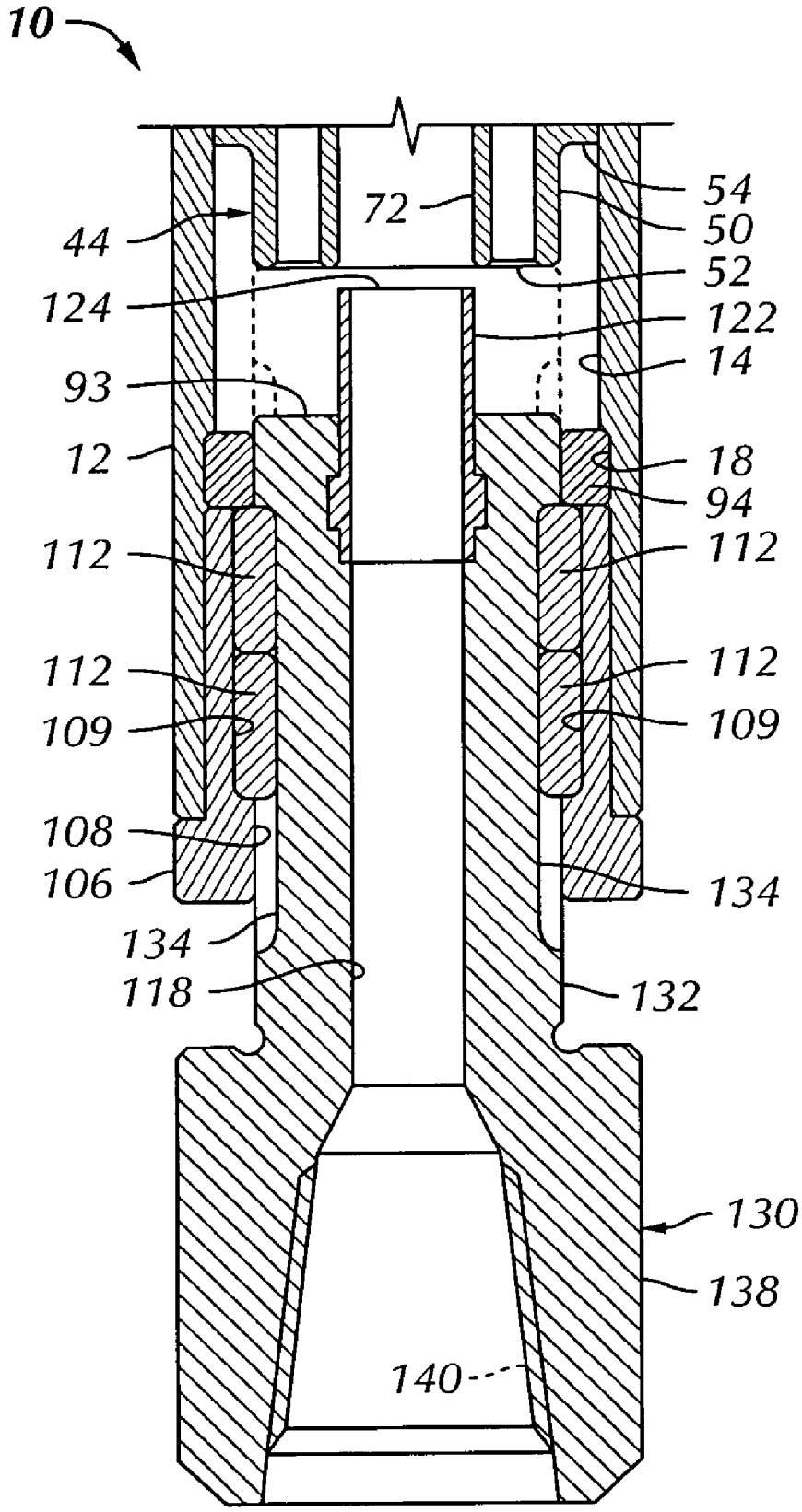
FIG. 4 is a longitudinal central section view of a modified bit adapter for use with the downhole percussion tool of the present invention.

Referring briefly to FIG. 4, there is illustrated a modified arrangement of a bit adapter or sub for the tool 10 of the present invention which may be used in place of the bit 92. As shown in FIG. 4, a bit sub 130 is provided having a cylindrical shank part 132 similar to the shank 90 of the bit 92 and provided with an impact blow receiving anvil surface 93 and circumferentially spaced longitudinal grooves 134 corresponding to the grooves 114 in the bit 92. The bit sub 130 includes an enlarged diameter end part 138 formed integral with the shank 132 and provided with a tapered threaded bore 140 for receiving a conventional claw bit, not shown, of a type available from, for example, Mills Machine Company, Inc. of Shawnee, Okla. Accordingly, the tool 10 may also be adapted to operate more efficiently and with superior performance as compared with heretofore available equipment, for penetrating earth formations utilizing a commercially available claw type bit.

Those skilled in the art will recognize that a superior tool has been developed for penetrating earth formations of medium to relatively high hardness not heretofore available for operations with claw type bits. Moreover, the realization that a claw type bit, such as the bit 92, may be utilized in combination with a reciprocating piston hammer type percussion tool, particularly of the type described herein, provides superior earth penetration rates in formations that would otherwise not be efficiently drillable with rotary type tools or conventional percussion type tools. Conventional engineering materials and manufacturing practices may be utilized in fabricating the tool 10 in accordance with the invention.

Although preferred embodiments of the invention have been described in detail herein, those skilled in the art will also recognize that various substitutions and modifications may be made without departing from the scope and spirit of the appended claims.

What is claimed is:

1. A pressure fluid actuated percussion tool comprising:

an elongated cylinder housing including opposed ends and a central bore forming a bore wall;

a reciprocating piston hammer disposed in said bore and having a first enlarged diameter portion in close fitting relationship with said bore wall of said housing, a first reduced diameter portion adjacent one end of said piston hammer and a second reduced diameter portion extending from said enlarged diameter portion in an opposite direction from said first reduced diameter portion;

a first sub connected to said housing at one of said housing ends and a second sub connected to said housing at the other of said housing ends;

first and second opposed chambers formed in said housing and delimited in part by said first reduced diameter portion and said second reduced diameter portion, respectively; and an impact blow receiving bit supported on said housing and including an anvil surface operable to receive repeated impact blows from said piston hammer, said bit including a shank part operably in driven engagement with said housing for rotating said bit while receiving impact blows, said bit including a plurality of circumferentially spaced bosses supporting formation cutting inserts thereon, respectively, for removing earth material from a borehole in response to rotation of said tool and deliverance of impact blows to and through said bit.

2. The percussion tool set forth in claim 1 including:

a third reduced diameter portion of said piston hammer having a diameter less than said second reduced diameter portion;

an elongated guide sleeve disposed in said housing including a first diameter portion and a second diameter portion for receiving in close fitting sliding relationship said second reduced diameter portion and said third reduced diameter portion of said piston hammer, respectively; and a third chamber formed in said housing and defined in part by said second reduced diameter portion of said guide sleeve for receiving pressure fluid to act on a transverse face of said piston hammer for driving said piston hammer toward an impact blow delivery position.

3. The percussion tool set forth in claim 2 including:

elongated passage means formed in said piston hammer and operable to be in communication with said third chamber for delivery of pressure fluid to said first chamber; and vent passage means formed in said piston hammer for venting said second chamber to a low pressure zone.

4. The percussion tool set forth in claim 3 wherein:

said bit includes an elongated hole cleaning fluid passage formed therein and in communication with a hole cleaning fluid passage in said piston hammer for delivering hole cleaning pressure fluid from said third chamber to said bit and to a borehole being formed by said tool.

5. The percussion tool set forth in claim 4 including:

an orifice in said hole cleaning passage in said piston hammer for limiting flow of pressure fluid from said third chamber to said hole cleaning fluid passage in said bit.

6. The percussion tool said set forth in claim 4 including:

a tube disposed on said shank part of said bit and operable to be in close fitting slidable relationship with a bore wall formed in an impact blow delivery end of said piston hammer whereby, when said piston hammer moves in a direction away from said bit, one end of said tube is operable to receive pressure fluid from said first chamber for reducing the fluid pressure therein and to permit reciprocation of said piston hammer to deliver an impact blow to said bit.

7. The percussion tool set forth in claim 6 wherein:

said tube is releasably retained on said bit and the position of said one end of said tube with respect to said anvil surface may be selected to modify one of impact blow intensity and impact blow frequency of said piston hammer.

8. The percussion tool set forth in claim 2 wherein:

said guide sleeve includes a fluid flow cutoff edge formed between said first and second diameter portions of said guide sleeve cooperable with said piston hammer for controlling the frequency of reciprocation of said piston hammer.

9. The percussion tool set forth in claim 8 wherein:

said guide sleeve is removably retained in said housing and is formed of a self-lubricating polymer material.

10. The percussion tool set forth in claim 9 wherein:

said guide sleeve is formed of graphite filled fluorocarbon polymer.

11. The percussion tool set forth in claim 2 including:

a check valve interposed said second sub and said third chamber, said check valve including a closure member biased into engagement with a seat surface on said second sub for closing off communication of pressure fluid between a passage in said second sub and said third chamber, a backing plate for said check valve, said backing plate supporting a biasing spring for biasing said closure member in a valve closed position; and plural circumferentially spaced screw fasteners engaged with said backing plate and with said second sub for retaining said check valve in a working position in said percussion tool.

12. The percussion tool set forth in claim 1 wherein:

said housing includes threaded parts at said ends for receiving said subs in releasable threaded engagement with said housing, said threaded parts being configured such that said subs may be connected to either end of said housing, respectively.

13. The percussion tool set forth in claim 1 wherein:

said bit includes a threaded adapter part for receiving a bit including a cooperating threaded part.

14. The percussion tool set forth in claim 1 wherein:

said cutting inserts include parts for releasably retaining said cutting inserts on said bosses, respectively.

15. The percussion tool set forth in claim 1 including:

a plurality of circumferentially spaced longitudinal grooves formed in said shank part of said bit and a plurality of cooperating circumferentially spaced longitudinal grooves formed in said first sub, and respective drive pins fined in said grooves in said bit and said first sub to form a driving connection between said bit and said housing permitting axial sliding movement of said bit with respect to said housing but responding to rotation of said housing to rotate said bit with said housing.

16. A pressure fluid actuated downhole percussion tool comprising:

an elongated cylinder housing including opposed ends and a central bore forming a bore wall;

a reciprocating piston hammer disposed in said bore and having a first enlarged diameter portion in close fitting relationship with said bore wall of said housing, a first reduced diameter portion adjacent one end of said piston hammer, a second reduced diameter portion extending from said enlarged diameter portion in an opposite direction from said first reduced diameter portion and a third reduced diameter portion having a diameter less than said second reduced diameter portion;

an elongated guide sleeve disposed in said housing including a first diameter portion and a second diameter portion for receiving in close fitting sliding relationship said second reduced diameter portion and said third reduced diameter portion of said piston hammer, respectively;

a first sub connected to said housing at one of said ends and a second sub connected to said housing at the other of said ends;

first and second chambers formed in said housing and delimited in part by said first reduced diameter portion and said second reduced diameter portion;

a third chamber formed in said housing and defined in part by said second reduced diameter portion of said guide sleeve for receiving pressure fluid to act on a transverse face of said piston hammer for driving said piston hammer toward an impact blow delivery position;

elongated passage means formed in said piston hammer and operable to be in communication with said third chamber for delivery of pressure fluid to said first chamber;

vent passage means formed in said piston hammer for venting said second chamber to a low pressure zone; and an impact blow receiving bit supported on said housing and including an anvil surface operable to receive impact blows from said piston hammer, said bit including a shank part operably in driven engagement with said housing for rotating said bit while receiving impact blows, said bit including a plurality of circumferentially spaced bosses supporting replaceable formation cutting inserts thereon for removing earth material from a borehole in response to rotation of said tool and deliverance of impact blows to and through said bit.

17. The percussion tool said set forth in claim 16 including:

a tube disposed on said shank part of said bit and operable to be in close fitting slidable relationship with a central bore wall formed in an impact blow delivery end of said piston hammer whereby, when said piston hammer moves in a direction away from said bit, one end of said tube is operable to receive pressure fluid from said first chamber for reducing the fluid pressure therein by venting pressure fluid to the exterior of said tool through passage means in said bit.

18. The percussion tool set forth in claim 16 including:

a plurality of circumferentially spaced longitudinal grooves formed in said shank part of said bit and a plurality of cooperating circumferentially spaced longitudinal grooves formed in said first sub, and respective drive pins fitted in said grooves in said bit and said first sub to form a driving connection between said bit and said housing permitting axial sliding movement of said bit with respect to said housing but responding to rotation of said housing to rotate said bit with said housing.

19. The percussion tool set forth in claim 16 wherein:

said guide sleeve includes a fluid flow cutoff edge formed between said first and second diameter portions of said guide sleeve and cooperable with said piston hammer for controlling the frequency of reciprocation of said piston hammer.

20. The percussion tool set forth in claim 19 wherein:

said guide sleeve is removably retained in said housing and is formed of a self-lubricating polymer material.

21. The percussion tool set forth in claim 16 wherein:

said housing includes threaded parts at said ends for receiving said subs in releasable threaded engagement with said housing, said threaded parts being configured such that said subs may be connected to either end of said housing, respectively.

22. A pressure fluid actuated downhole percussion tool comprising:

an elongated cylinder housing including opposed ends and a central bore forming a bore wall;

a reciprocating piston hammer disposed in said bore and having a first enlarged diameter portion in close fitting relationship with said bore wall of said housing, a first reduced diameter portion adjacent one end of said piston hammer, a second reduced diameter portion extending from said enlarged diameter portion in an opposite direction from said first reduced diameter portion and a third reduced diameter portion having a diameter less than said second reduced diameter portion;

an elongated guide sleeve disposed in said housing including a first diameter portion and a second diameter portion for receiving in close fitting sliding relationship said second reduced diameter portion and said third reduced diameter portion of said piston hammer, respectively;

a first sub connected to said housing at one of said ends and a second sub connected to said housing at the other of said ends;

first and second chambers formed in said housing and delimited in part by said first reduced diameter portion and said second reduced diameter portion;

a third chamber formed in said housing and defined in part by said second reduced diameter portion of said guide sleeve for receiving pressure fluid to act on a transverse face of said piston hammer for driving said piston hammer toward an impact blow delivery position;

elongated passage means formed in said piston hammer and operable to be in communication with said third chamber for delivery of pressure fluid to said first chamber;

vent passage means formed in said piston hammer for venting said second chamber to a low pressure zone; and an impact blow receiving bit supported on said housing and including an anvil surface operable to receive impact blows from said piston hammer, said bit including a shank part operably in driven engagement with said housing for rotating said bit while receiving impact blows.

23. The percussion tool said set forth in claim 22 including:

a tube disposed on said shank part of said bit and operable to be in close fitting slidable relationship with a central bore wall formed in an impact blow delivery end of said piston hammer whereby, when said piston hammer moves in a direction away from said bit, one end of said tube is operable to receive pressure fluid from said first chamber for reducing the fluid pressure therein by venting pressure fluid to the exterior of said tool through passage means in said bit.

24. The percussion tool set forth in claim 22 including:

a plurality of circumferentially spaced longitudinal grooves formed in said shank part of said bit and a plurality of cooperating circumferentially spaced longitudinal grooves formed in said first sub, and respective drive pins fined in said grooves in said bit and said first sub to form a driving connection between said bit and said housing permitting axial sliding movement of said bit with respect to said housing but responding to rotation of said housing to rotate said bit with said housing.

25. The percussion tool set forth in claim 22 wherein:

said guide sleeve includes a fluid flow cutoff edge formed between said first and second diameter portions of said guide sleeve and cooperable with said piston hammer for controlling the frequency of reciprocation of said piston hammer.

26. The percussion tool set forth in claim 22 wherein:

said housing includes threaded parts at said ends for receiving said subs in releasable threaded engagement with said housing, said threaded parts being configured such that said subs may be connected to either end of said housing, respectively.

27. An impact blow receiving bit for operation with a pressure fluid actuated percussion tool comprising an elongated cylinder housing including opposed ends and a central bore forming a bore wall, a reciprocating piston hammer disposed in said bore and having an enlarged diameter portion in close fitting relationship with said bore wall of said housing and first and second opposed chambers formed in said housing and delimited in part by said piston hammer, said bit comprising:

an anvil surface formed on a shank part of said bit operable to receive repeated impact blows from said piston hammer, said shank part operably in driven engagement with a member connected to said housing for rotating said bit while receiving impact blows, and a plurality of circumferentially spaced bosses disposed on a head part at one end of said bit for supporting formation cutting inserts thereon, said cutting inserts include parts for releasably retaining said cutting inserts on said bosses, respectively, for removing earth material from a borehole in response to rotation of said bit and deliverance of impact blows to and through said bit.

28. An impact blow receiving bit for operation with a pressure fluid actuated percussion tool comprising an elongated cylinder housing including opposed ends and a central bore forming a bore wall, a reciprocating piston hammer disposed in said bore and having an enlarged diameter portion in close fitting relationship with said bore wall of said housing and first and second opposed chambers formed in said housing and delimited in part by said piston hammer, said bit comprising:

an anvil surface formed on a shank part of said bit operable to receive repeated impact blows from said piston hammer, said shank part operably in driven engagement with a member connected to said housing for rotating said bit while receiving impact blows, and a plurality of circumferentially spaced bosses disposed on a head part at one end of said bit for supporting formation cutting inserts thereon, respectively, for removing earth material from a borehole in response to rotation of said bit and deliverance of impact blows to and through said bit, said shank part having a plurality of circumferentially spaced longitudinal grooves and said member having a plurality of cooperating circumferentially spaced longitudinal grooves connected to said housing, and respective drive pins fitted in said grooves in said bit and said member connected to said housing to form a driving connection between said bit and said housing permitting axial sliding movement of said bit with respect to said housing but responding to rotation of said member connected to said housing to rotate said bit.

29. An impact blow receiving bit for operation with a pressure fluid actuated percussion tool comprising an elongated cylinder housing including opposed ends and a central bore forming a bore wall, a reciprocating piston hammer disposed in said bore and having an enlarged diameter portion in close fitting relationship with said bore wall of said housing and first and second opposed chambers formed in said housing and delimited in part by said piston hammer, said bit comprising:

an anvil surface formed on a shank part of said bit operable to receive repeated impact blows from said piston hammer, said shank part operably in driven engagement with a member connected to said housing for rotating said bit while receiving impact blows, and a plurality of circumferentially spaced bosses disposed on a head part at one end of said bit for supporting formation cutting inserts thereon, wherein said cutting inserts project from said bosses, respectively, at acute angles with respect to a longitudinal central axis of said bit for removing earth material from a borehole in response to rotation of said bit and deliverance of impact blows to and through said bit.

* * * * *